United States Patent [19]

Miljevic

[11] Patent Number: 4,871,918

[45] Date of Patent: Oct. 3, 1989

[54] HOLLOW-ANODE ION-ELECTRON SOURCE

[75] Inventor: Vujo I. Miljevic, Belgrade, Yugoslavia

[73] Assignee: The Institute for Atomic Physics, Belgrade, Yugoslavia

[21] Appl. No.: 105,712

[22] Filed: Oct. 6, 1987

[30] Foreign Application Priority Data

Oct. 23, 1986 [YU] Yugoslavia ..... 1810/86

[51] Int. Cl.[4] ..... H01J 27/02

[52] U.S. Cl. ..... 250/423 R; 250/424; 250/426; 315/111.81

[58] Field of Search ..... 250/423 R, 424, 426, 250/423 F; 315/111.21, 111.31, 111.41, 111.81, 111.91; 313/361.1, 362.1

[56] References Cited

U.S. PATENT DOCUMENTS

| | | | |
|---|---|---|---|
| 2,821,662 | 1/1958 | Bell, Jr. et al. | 315/111.81 |
| 3,411,035 | 11/1968 | Necker et al. | 315/111.81 |
| 3,944,873 | 3/1976 | Franks et al. | 315/111.81 |
| 4,475,063 | 10/1984 | Aston | 315/111.81 |
| 4,596,945 | 6/1986 | Schumzcher et al. | 315/344 |
| 4,647,818 | 3/1987 | Ham | 315/111.21 |
| 4,658,143 | 4/1987 | Tokiguchi et al. | 250/423 R |
| 4,739,214 | 4/1988 | Barr | 313/362.1 |

*Primary Examiner*—Jack I. Berman
*Attorney, Agent, or Firm*—Ladas & Parry

[57] ABSTRACT

An ion-electron source based on a new type of gas discharge in a hollow anode is presented. A small surface of the exit aperture and a high density of the current enable high brightness of the source; high efficiency and simple construction make possible low production price and long lifetime of the source.

27 Claims, 2 Drawing Sheets

HOLLOW-ANODE ION-ELECTRON SOURCE

BACKGROUND OF INVENTION

This invention relates to a hollow anode ion-electron source in which electrons (when the source is used as a plasma cathode) and ions of different elements, without ions of anode or cathode materials, with a high efficiency are obtained.

High efficiency and simple construction enable a long lifetime and a low production price of the source.

It is well known that the present ion sources and electron sources (plasma cathodes) are based mainly on arc or glow discharge with hot emission or cold cathodes. In the first case a very intense, low-voltage arc discharge followed by intense cathode destruction are achieved, making thus the source lifetime usually short. In the second case high voltage glow discharges in different geometries are used. In both cases the sources are of a rather complex construction, made of specific materials and high technology which makes them usually expensive.

It is, therefore, an object of the present invention to provide high efficiency, low price and long lifetime hollow anode ion-electron source.

Further object of the present invention is to provide a cold cathode hollow anode ion source with high purity ion beam.

Still another object of the invention is to provide a cold cathode very high efficiency hollow anode electron source.

SUMMARY OF THE INVENTION

The present invention is directed to provide high efficiency ion-electron source based on a hollow anode discharge.

To accomplish this object, the ion-electron source in accordance with the present invention consists of an intensive, inhomogeneous discharge with maximal electron temperature and ion density concentrated in the hollow anode representing in the same time an exit aperture of the source. The effect of the present invention can be further enhanced by applying a magnetic field on the hollow anode aperture.

Hollow anode discharge in a magnetic field is generally used as a plasma generation means which can be used in both the ion and electron (plasma cathode) sources.

Another enhancement of the source efficiency is obtained with an additional magnetic field in the extraction gap.

High efficiency, long lifetime, simple construction and low production price are the main features of this novel hollow anode ion-electron source.

Other objects, purposes and advantages of the invention will appear from the description of the drawings which follows.

BRIEF DESCRIPTION OF THE DRAWINGS

FIG. 1B is an enlarged schematic cross-sectional elevational of a portion of the hollow anode ion-electron source of FIG. 1A;

DETAILED DESCRIPTION OF THE PREFERRED EMBODIMENTS

Figure 1A:
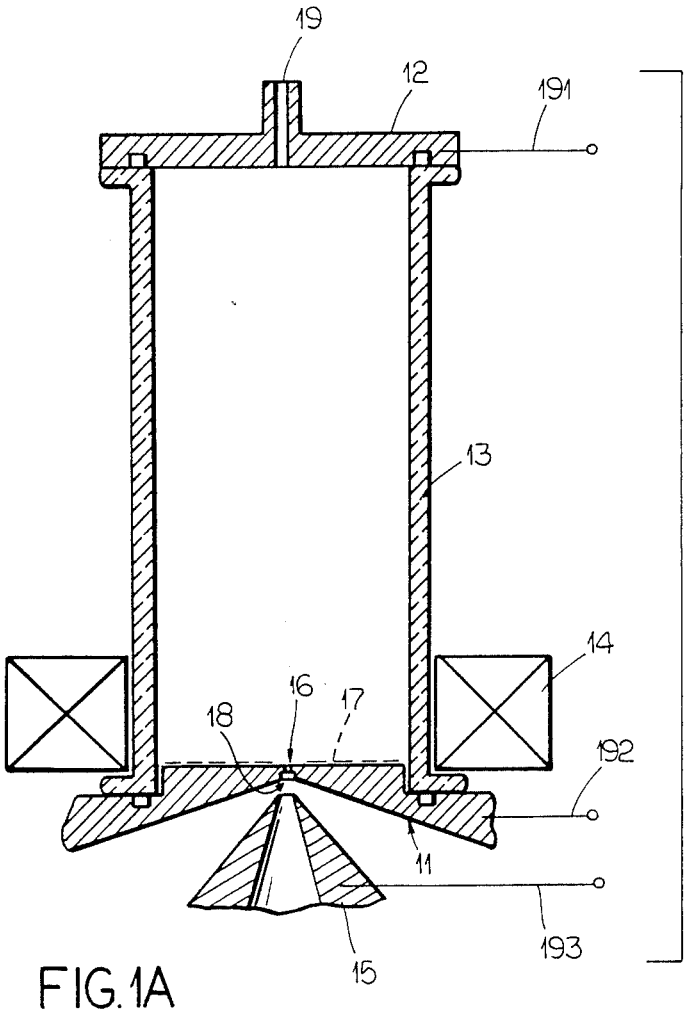
FIG. 1*a* and 1*b* are schematic cross-sectional elevationals showing a hollow anode ion-electron source.
Figure 1B:
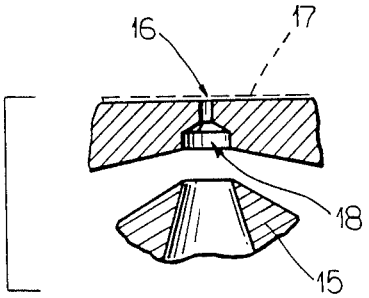

FIG. 1 is a cross-section view showing the structure of a hollow anode ion-electron source in accordance with the first embodiment of the present invention.

This embodiment uses hollow anode discharge in a magnetic field as a means for generating plasma. It is realized in a discharge tube consisting of a hollow anode electrode 11, cathode 12, housing 13, permanent or electromagnet 14, and extraction electrode 15. 191, 192 and 193 are the cathode anode and extraction electrode leads respectively The hollow anode can be realized, for example, in the following way; the electrode with the aperture (usually 0,5 or 1 mm in diameter) is insulated from the upper side facing the cathode, making thus only the inner surface of the aperture conductive. This electrode, in the shape of a disc, for example, can be of aluminum or some other material. In general, a hollow anode represents any electrode having the aperture with only inner surface conductive, and it can be of circular, rectangular or other shape. The lower side of the hollow anode 11 is the exit aperture of the source 18 and together with the extraction electrode 15 it represents the modified Pierce's system. However, it is not necessary that the extraction system consists of the Pierce geometry. But it provides the optimal conditions for the current extraction from the "developed plasma surface".

In our case the upper side of the disc (facing the cathode) is insulated by a thin ceramic layer deposited by plasma arc (dashed line 17 in FIG. 1) thus making the inner surface of the aperture (usually 0.5 or 1 mm in diameter) conductive. A detail of the anode aperture 16, insulated with a thin ceramic layer 17 and the Pierce geometra 15–18 is given in a circle in FIG. 1. A magnetic field in a hollow anode and in extraction gap is obtained by means of electro or permanent magnet 14 in the following way:

(a) The extraction electrode 15 is made of magnetic material, so that the inhomogeneous magnetic field of the maximal intensity is obtained in the hollow anode aperture.

(b) The extraction electrode 15 is made of non magnetic material and the magnetic field is practically homogeneous in the hollow anode aperture.

Naturally, the choice of the hollow material depends, besides, on desired configuration of the magnetic field.

An electrode 12 (aluminum disc) placed on the opposite side of a glass tube 13 is a cathode. It usually has an inlet 19 for gas supply of the source.

Cathodes of different shapes (cylindrical, rod and others) can be used, but the most suitable are the flat cathode and concave cathode with the curvature radius equal to the anode-cathode distance. In our case cathodes of different diameters and shapes (flat or concave), with diameters smaller than the anode-cathode distance, are used.

When the hollow anode discharge is established in the source, between the cathode and hollow anode a non-uniform plasma distribution, with maximal ion density and electron temperature in the hollow anode or exit aperture, is obtained. The efficiency of ionization can be further enhanced by applying a magnetic field on the hollow anode discharge. A small surface of the exit aperture and high density of the current enable high "brightness" and high efficiency of the source.

Another enhancement of the source efficiency is obtained with additional magnetic field in the extraction gap. The geometry of this field depends on the hollow anode - extraction electrode material combination.

Ion-electron sources are made by means of a high vacuum technology. Dimensions of the sources are not critical and depend on application. In our case (FIG. 1) a discharge tube was 10 cm long and 4 cm in inner diameter. Operating pressure is usually of the order of 0.01–1 m bar, and for a discharge current of 10 mA and magnetic field B=0–0.05T a discharge voltage is about 400–500 V. By choosing optimal operation conditions maximal efficiency of the source may be obtained.

Embodiment 2

Figure 2:
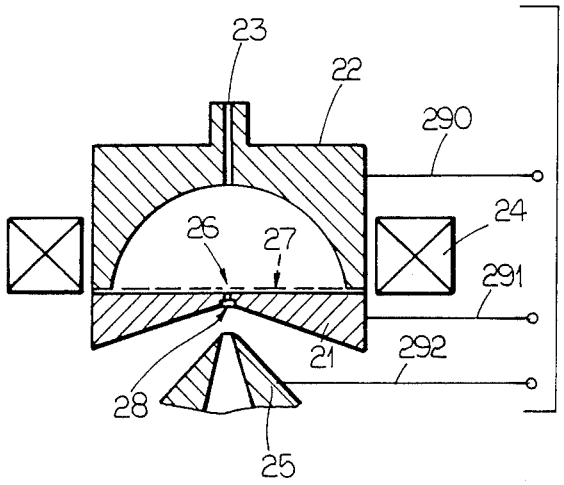
FIG. 2 is a schematic cross-section showing elevational another hollow anode ion-electron source with hemispherical cathode.

FIG. 2 is a cross-section view of the hollow anode ion-electron source in accordance with the second embodiment of the present invention.

In this embodiment a hemispherical cathode 22 with a hollow anode aperture 26 in the center of curvature is used. The hemispherical cathode may have an inlet 23 for gas supply into the source. The hollow anode electrode 21, magnet 24, thin ceramic layer 27, Pierce extraction system 25–28 and magnetic field in the hollow anode and the extraction gap (depending on the hollow anode - extraction electrode material combination) are the same as in the previous embodiment.

The concave cathode focuses electrons into the hollow anode and increases the efficiency of excitation and ionization in the aperture. Efficiency of the ionization is further enhanced by applying a magnetic field localized in the hollow anode aperture and extraction gap.

Embodiment 3

Figure 3:
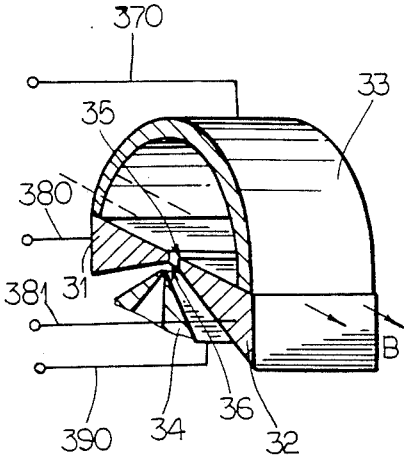
FIG. 3 is a perspective view showing, partly in cross section, another, cylindrical hollow anode ion-electron source with rectangular aperture and a magnetic field in the hollow anode plane.

FIG. 3 is a perspective view of the hollow anode ion-electron source with rectangular aperture in accordance with the third embodiment of the present invention.

In this embodiment a hollow anode electrode consists of two parts 31 and 32 made of magnetic material. In this case the magnetic field B is obtained only in the hollow anode aperture 35 between parts 31 and 32. Combining it with the extraction electrode 34 of (a) magnetic or (b) non magnetic material different configuration of the magnetic field in the hollow anode aperture and extraction gap may be obtained. Apart from that, parts of the hollow anode 31 and 32 can be on the same or different potentials. Other details are the same as in the previous embodiments.

Semicylindrical cathode 33 focuses electrons into the rectangular hollow anode and increases efficiency of ionization in the aperture. Efficiency of ionization is further enhanced by appplying a magnetic field localized in the hollow anode aperture and extraction gap.

Embodiment 4

Figure 4:
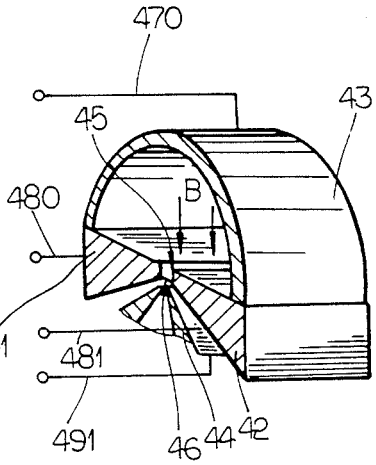
FIG. 4 is a perspective view showing, partly in cross section, another, cylindrical hollow anode ion-electron source with rectangular aperture and component of magnetic field normal to the hollow anode plane.

FIG. 4 is a perspective view of the hollow anode ion-electron source with rectangular aperture in accordance with the fourth embodiment of the present invention.

In this embodiment a hollow anode consists of two parts 41 and 42, made of non magnetic material. In this case the lines of magnetic field have a component normal to the plane of the hollow anode aperture 45. Combining it with the extraction electrode of (a) magnetic or (b) non magnetic material different configurations of magnetic field in the hollow anode and extraction gap can be obtained. Apart from that, parts of the hollow anode 41 and 42 may be on the same or different potentials. Other details are the same as in the previous embodiments.

Obviously many modifications and variations of the present invention are possible. It is therefore to be understood that within the scope of the appended claims, the invention may be practiced otherwise than specifically described herein.

What is claimed is:

1. A hollow anode ion-electron source comprising:

a housing or discharge tube, having a gas inlet opening;

a hollow anode within the housing, said anode comprising an aperture having an inner surface wherein only said inner surface is conductive, said aperture functioning as an exit aperture of the source;

a cathode within the housing spaced from the hollow anode aperture;

an extraction electrode; and connecting means for connecting the anode, cathode, and extraction electrode to power supplies.

2. The source of claim 1 wherein the cathode is concave about a center of curvature and the hollow anode aperture is in the center of curvature.

3. The source of claim 1 wherein the cathode is hemispherical with a center of curvature and the hollow anode aperture is in the center of curvature.

4. The source of claim 1 wherein a magnetic field with a component normal to the plane of the hollow anode aperture is supplied.

5. The source of claim 4 wherein the extraction electrode is of non magnetic material.

6. The source of claim 4 wherein the extraction electrode is of magnetic material.

7. The source of claim 4 wherein the hollow anode aperture is rectangular and consists of two parts of magnetic material, with conductive opposite surfaces, so that the magnetic field may be obtained only in the hollow anode aperture.

8. The source of claim 7 wherein the hollow anode parts are at different potentials.

9. The source of claim 7 wherein the hollow anode parts are at the same potential.

10. The source of claim 4 wherein the hollow anode aperture is rectangular and consists of two parts of non magnetic material with conductive opposite surfaces.

11. The source of claim 10 wherein the hollow anode parts are at different potentials.

12. The source of claim 10 wherein the hollow anode parts are at the same potential.

13. The source of claim 7, wherein the extraction electrode is of a non magnetic material.

14. The source of claim 8, wherein the extraction electrode is of a non magnetic material.

15. The source of claim 9, wherein the extraction electrode is of a non-magnetic material.

16. The source of claim 10, wherein the extraction electrode is of a non magnetic material.

17. The source of claim 11, wherein the extraction electrode is of a non magnetic material.

18. The source of claim 12, wherein the extraction electrode is of a non-magnetic material.

19. The source of claim 7, wherein the extraction electrode is of a magnetic material.

20. The source of claim 8, wherein the extraction electrode is of a magnetic material.

21. The source of claim 9, wherein the extraction electrode is of a magnetic material.

22. The source of claim 10, wherein the extraction electrode is of a magnetic material.

23. The source of claim 12, wherein the extraction electrode is of a magnetic material.

24. The source of claim 12, wherein the extraction electrode is of a magnetic material.

25. The source of claim of claim 1, wherein the cathode is semicylindrical with the hollow anode aperture in the center of curvature.

26. The source of claim of claim 7, wherein the cathode is semicylindrical with the hollow anode aperture in the center of curvature.

27. The source of claim of claim 10, wherein the cathode is semicylindrical with the hollow anode aperture in the center of curvature.

* * * * *